US006356254B1

(12) United States Patent
Kimura

(10) Patent No.: US 6,356,254 B1
(45) Date of Patent: Mar. 12, 2002

(54) ARRAY-TYPE LIGHT MODULATING DEVICE AND METHOD OF OPERATING FLAT DISPLAY UNIT

(75) Inventor: Koichi Kimura, Fujinomiya (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 09/404,541

(22) Filed: Sep. 24, 1999

(30) Foreign Application Priority Data

Sep. 25, 1998 (JP) ..... 10-271706

(51) Int. Cl.[7] ..... G09G 3/34
(52) U.S. Cl. ..... 345/108; 345/84; 345/211
(58) Field of Search ..... 345/84, 85, 108, 345/109, 211–214; 348/203, 205, 800; 359/196, 201, 202, 209, 212, 223, 290, 291

(56) References Cited

U.S. PATENT DOCUMENTS 4,564,836 A * 1/1986 Vuilleumier et al. ..... 345/85
5,019,808 A * 5/1991 Prince et al. ..... 345/88
5,480,582 A * 1/1996 Pope ..... 252/301.4 F
5,745,281 A * 4/1998 Yi et al. ..... 359/290
5,764,208 A * 6/1998 Burton et al. ..... 345/85
6,028,978 A * 2/2000 Takeuchi et al. ..... 385/147
6,195,196 B1 * 2/2001 Kimura et al. ..... 359/295
6,201,521 B1 * 3/2001 Doherty ..... 345/84
6,218,774 B1 * 4/2001 Pope ..... 313/461

* cited by examiner

*Primary Examiner*—Richard Jherpe
*Assistant Examiner*—Alexander Eisen
(74) *Attorney, Agent, or Firm*—Sughrue Mion, PLLC

(57) ABSTRACT

It is an object to provide an array-type light modulating device and a method of operating a flat display unit with which even electromechanical light modulating devices, which require a long time to restore the original positions, are able to significantly shorten substantial response time without deterioration in the image quality and loss occurring owning to the restoring time.

An array-type light modulating device incorporating electromechanical light modulating devices which are arranged to perform light modulation by using an operation for displacing flexible portions by dint of electrostatic force and an elastic restoring operation of the flexible portions and which are disposed into a two-dimensional matrix configuration, wherein a resetting operation of the light modulating devices is performed simultaneously with a writing operation period for scanning lines except for the present scanning lines so that the resetting operation is completed before the writing operation for the light modulating devices to continuous perform the writing operation for each scanning line.

13 Claims, 13 Drawing Sheets

ARRAY-TYPE LIGHT MODULATING DEVICE AND METHOD OF OPERATING FLAT DISPLAY UNIT

BACKGROUND OF THE INVENTION

1. Field of the Invention

The present invention relates to an array-type light modulating device which is manufactured by micromachining and which is arranged to change the light transmittance by an electromechanical operation thereof and a method of operating a flat display unit incorporating the array-type light modulating device, and more particularly to a technique for raising the response speed of the array-type light modulating device and the flat display unit.

2. Description of the Related Art

An electromechanical light modulating device has been known which has a structure that thin flexible films manufactured by micromachining are mechanically operated by electrostatic force so that light modulation is performed. As an example of the light modulating device, a structure is known in which thin flexible films each of which is composed of transparent electrodes and a diaphragm are, through support portions, supported by fixed electrodes formed on a light conductive plate.

The foregoing light modulating device is arranged such that a predetermined voltage is applied between the two electrodes so as to generate electrostatic force between the electrodes so that the thin flexible films are deflected toward the fixed electrode. As a result, the optical characteristic of the device is changed to permit light to penetrate the light modulating device. When the applied voltage is made to be zero, the thin flexible film is elastically restored. Thus, the light modulating devices shield light. Thus, light modulation is performed.

When the thin flexible film is deformed or elastically restored by the electrostatic force, the relationship between the applied voltage Vgs and the displacement of the thin flexible film has a hysteresis characteristic. Therefore, also the relationship between the applied voltage Vgs and the light transmittance T has a hysteresis characteristic, as shown in FIG. 17.

With the foregoing hysteresis characteristic, in a state in which a light modulating element is turned off (light is shielded), the turned-off state is maintained when Vgs is not higher than Vth(L). When Vgs is not lower than Vth(H), the turned-on state is maintained. When Vgs is not lower than Vth(H), the light modulation element maintains the turned-on state. When Vgs is not higher than Vs(L), the light modulating element is saturated to the turned-off state. When Vgs has the negative polarity, a positive characteristic is realized which is symmetrical with respect to the axis of ordinate.

A response characteristic of transmitted light is shown in FIG. 18, the characteristic being realized in accordance with the foregoing hysteresis characteristic such that Vs(H) is applied as the applied voltage Vgs in an equilibrium state (a turned-off state) in which no electrostatic stress is not generated in the thin flexible film, followed by making Vgs to be zero after the thin flexible film has sufficiently be deformed.

According to FIG. 18, first transition time $\tau\Gamma$ owning to application of the voltage is time caused from electrostatic force (attracting force). Therefore, quick displacement response is realized and also optical response caused from the displacement response is quickly performed. When the applied voltage Vgs is furthermore raised, the response time can be shortened.

On the other hand, the fall time $\tau f$ is elastic restoring time which is determined by the material and the shape of the thin flexible film. Therefore, the fall time $\tau f$ is slower than the first transition time $\tau\Gamma$, in general. As a matter of course, control by dint of the applied voltage cannot be performed.

Therefore, when the light modulating devices are operated in a two-dimensional matrix, scanning time $\tau$ for writing image signals which must be input to the light modulating pixels is undesirably limited to the slower response time. In the foregoing example, scanning time $\tau$ is made to be the fall time $\tau f$. When the scanning time is slow as described above, there arises a problem in that the number of the rows of the matrix cannot be enlarged. When an operating method is employed which realizes the gray scale using time division, another problems arise in that the number of gray-scale levels cannot be enlarged.

A structure having the above-mentioned hysteresis characteristic encounters a fact that a state of the thin flexible film in a state before the writing operation exerts an influence on a next operation. Therefore, to accurately perform the writing operation with satisfactory repeatability, it is preferable that a resetting operation, that is, an equilibrium state (a turned-off state) is realized before the writing operation is performed. Then, the writing operation is performed to realize a required transmittance. If the resetting operation is simply performed before the writing operation, the scanning time for each row, however, is elongated excessively. In this case, the foregoing problem becomes more critical.

It might therefore be feasible to obtain a quick response characteristic by increasing the rigidity of each fluorescent portion of the light modulating device. However, the operating voltage is raised, causing the operating circuit to bear a heavier load. As a result, cost and size reductions are inhibited.

SUMMARY OF THE INVENTION

In view of the foregoing, an object of the present invention is to provide an array-type light modulating device and a method of operating a flat display unit with which loss caused from the restoring time can be prevented without deterioration in the image quality and the substantial response time can significantly be shortened if the electromechanical light modulating devices require a long restoring time.

To achieve the foregoing object, according to a first aspect, there is provided a method of operating an array-type light modulating device incorporating electromechanical light modulating devices which are arranged to perform light modulation by using an operation for displacing flexible portions by dint of electrostatic force and an elastic restoring operation of the flexible portions and which are disposed into a two-dimensional matrix configuration, the method of operating an array-type light modulating device comprising the steps of: performing a resetting scan operation which restores the light modulating devices, which is performed for scanning lines except for scanning lines which are reset and which is performed simultaneously with writing scan operation for selecting either of an operation for displacing the devices or an operation for maintaining the present state so that the writing scan operation of each scanning line is continuously performed.

Namely the present invention is characterized in that the resetting scan operation for selected scanning lines is performed within writing scan operation period for scanning lines except for the selected scanning lines.

The foregoing method of operating the array-type light modulating device is arranged to perform the reset scanning operation of the light modulating devices simultaneously with the writing scan operation time for the scanning lines except for the reset scanning line. Therefore, the writing scan for each scanning line can be performed without any loss even if the light modulating devices require a long time to elastically restore the original positions. Therefore, the response time of the array-type light modulating device can significantly be shortened.

A method of operating an array-type light modulating device according to a second aspect is a method, wherein the resetting scan operation for selected scanning lines is performed simultaneously with writing scan operation for scanning lines except for the selected scanning lines so that the writing scan operation of each scanning line is continuously performed.

A method of operating an array-type light modulating device according to a third aspect has a structure that reset scanning time is set to be an integer multiple of writing scan time.

The foregoing method of operating the array-type light modulating device is structured such that the reset scanning time is set to be an integer multiple of the writing scan time. Therefore, the reset scanning time can be elongated by performing a simple change of the design such that a wide degree of design freedom is maintained. If the devices require a long time to elastically restore the original position, the devices can be operated without reduction in the response speed.

A method of operating an array-type light modulating device according to a fourth aspect has a structure that reset scanning operation time is set to be longer than time required for each flexible portion to elastically restore the original position.

The foregoing method of operating the light modulating devices is structured such that the resetting operation is the elastic restoring operation of each of the flexible portions of the light modulating devices. When the reset operation time is set to be longer than the elastic restoring time for the flexible portion, the start of the writing operation is not performed at timing during the elastic restoring operation. Therefore, the operation method enables the elastic restoration to reliably be performed. When the reset operation time is approximated to the elastic restoration time, the writing operation for each device can be performed immediately after the resetting operation. Therefore, the devices can efficiently be operated.

A method of operating an array-type light modulating device according to a fifth aspect has a structure that the elastic restoring operation of each light modulating device is an operation which realizes a light shielded state after the restoration has been completed.

The foregoing method of operating the light modulating device is structured such that the light shielded state is realized after the elastic restoring operation, which is the operation for resetting each light modulating device, has been completed. Therefore, when "black" is, as an image, output in a case where the resetting operation is performed, the light-shielded state is maintained. When "white" is output, the output is reduced in only the resetting period. However, no critical problem arises. When the resetting operation is performed by realizing the light-transmissible state, output of "black" as the image results in light transmission being caused by the resetting operation. Therefore, the contrast is considerably lowered. As a result, the foregoing lowering of the contrast can be prevented.

A method of operating a flat display unit according to a sixth aspect and incorporating the array-type light modulating device, a flat light source disposed opposite to the array-type light modulating-device and fluorescent members disposed opposite to the flat light source such that the array-type light modulating device is interposed, the method of operating a flat display unit comprising the steps of: operating the array-type light modulating device by an operating method according to any one of the first to fourth aspect; and using light emitted from the array-type light modulating device to cause fluorescent members to emit light to perform display.

The foregoing method of operating the flat display unit, which incorporates the electromechanical array-type light modulating device arranged to complete the resetting operation before the writing operation for each device to short the response time, is structured such that light transmitted through the array-type light modulating device is used to cause the fluorescent members to emit light to perform display. Therefore, the flat display unit can quickly be operated.

A method of operating a flat display according to a seventh aspect has a structure that the flat light source is a light source for emitting ultraviolet rays for exciting the fluorescent members.

The method of operating the flat display unit is able to cause the fluorescent members to be excited to emit light by transmitting or shielding ultraviolet rays emitted from the flat light source by the light modulating devices.

PREFERRED EMBODIMENTS OF THE INVENTION

Figure 1A:
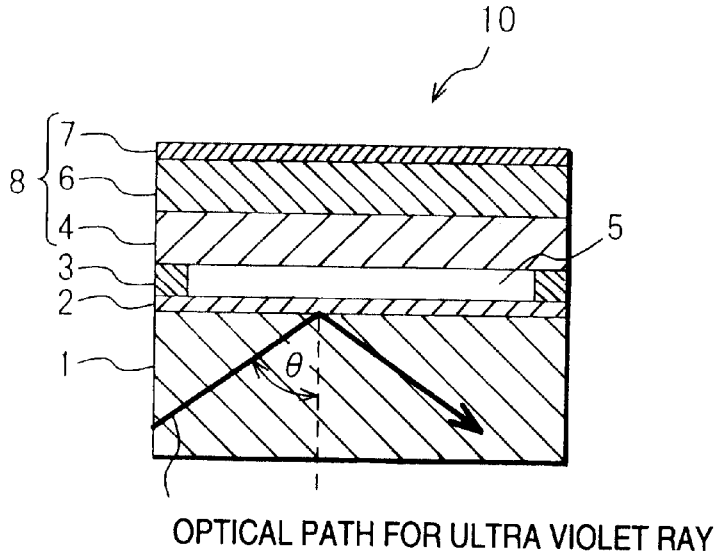
FIG. 1 is a cross sectional view showing a light modulating operation of a light modulating device according to a first embodiment of the present invention.
Figure 1B:
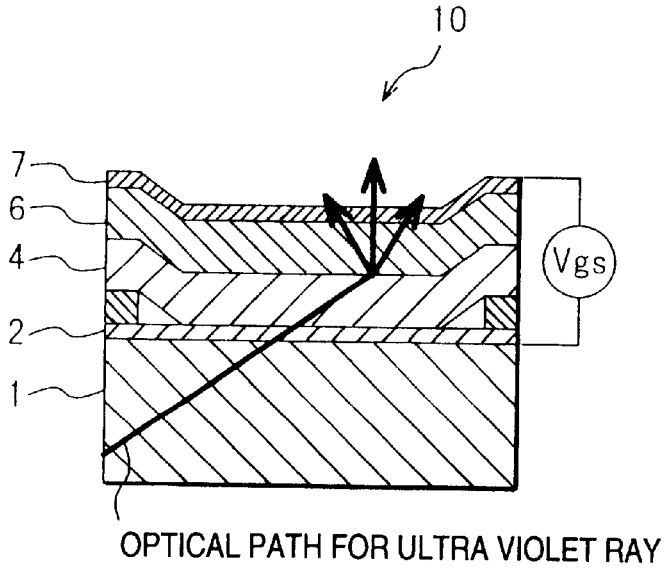

Embodiments of the present invention will now be described with reference to the drawings. FIG. 1 shows the structure of a light modulating device according to a first embodiment of the present invention.

The principle on which a thin flexible film is electromechanically operated to perform light modulation will now be described. A light introduction and diffusion operation (hereinafter called "light introduction and diffusion") can be used which can be realized by bringing a thin flexible film and a transparent signal electrode with each other or by separating the same from each other. The light introduction and diffusion is performed such that a cavity is used as transmission resistance against light. When the cavity is formed, light emitted from a signal electrode is shielded or attenuated. Only when the thin flexible film is brought into contact with the signal electrode, light emitted from the signal electrode is introduced (mode-coupled) into the thin flexible film. Then, light is diffused by the thin flexible film so that the intensity of light emitted from the thin flexible film is controlled (light modulation is performed).

As shown in FIG. 1, an electrode (a signal electrode) 2 which is transparent with respect to an ultraviolet ray is formed on a light introducing plate 1. The foregoing electrode may be made of a metal oxide, such as ITO, having a high electron density or constituted by a very thin metal film (made of aluminum or the like), a thin film in which metal particles are dispersed in a transparent insulating material, or a wide-hand-cap semiconductor of a high density doped type.

Insulating support portions 3 are formed on the electrode 2. The support portions 3 may be, for example, silicon oxide, silicon nitride, ceramic or resin. A diaphragm 4 is formed on the upper surface of each of the support portions 3. A gap (a cavity) 5 is formed between the electrode 2 and the diaphragm 4. The diaphragm 4 may be made of a semiconductor, such as polysilicon, insulating silicon oxide, silicon nitride, ceramic or resin. It is preferable that the refractive index of the diaphragm 4 is similar to or higher than that of the light introducing plate 1.

A light diffusing layer 6 is formed on the diaphragm 4, the light diffusing layer 6 being structured such that projections and depressions, microprisms or microlenses are formed on an inorganic or organic transparent material or inorganic or organic porous material or fine particles having different refractive indexes are dispersed in a transparent substrate.

Another electrode (a scanning electrode) 7 which is transparent with respect to an ultraviolet ray is formed on the light diffusing layer 6. The electrode 7 may be made of the same material as the material which constitutes the electrode 2. The diaphragm 4, the light diffusing layer 6 and the electrode 7 constitute a thin flexible film 8 serving as a flexible portion.

The cavity 5 exists between the light introducing plate 1 and the diaphragm 4. The cavity 5 is substantially determined by the height of each of the support portions 3. It is preferable that the height of the cavity 5 is about 0.1 $\mu$m to 10 $\mu$m. The cavity 5 is usually formed by etching a sacrifice layer.

As an alternative to this, the diaphragm 4 and the light diffusing layer 6 are made of the same material. For example, the diaphragm 4 may be constituted by a nitride silicon film and projections and depressions maybe provided for the upper surface. Thus, the diffusion function can be realized.

The principle for operating the light modulating device 10 structured as described above will now be described.

When the voltage application is inhibited, the voltages of the electrodes 2 and 7 are zero, the cavity 5 (for example, air) exists between the diaphragm 4 and the light introducing plate 1 and an assumption is made that the refractive index of the light introducing plate 1 is nw, total reflection critical angle θc is as follows:

$$\theta c = \sin^{-1}(nw)$$

Therefore, the ultraviolet ray totally reflects in the light introducing plate 1 and travels in the light introducing plate 1 as shown in FIG. 1(*a*) when the incident angle θ on the interface satisfies θ>θc.

When voltage is applied to the two electrodes 2 and 7 when the application of the voltage is being performed and the diaphragm 4 and the surface of the light introducing plate 1 are brought into contact with each other or allowed to come closer sufficiently, the ultraviolet ray is transmitted and allowed to penetrate toward the diaphragm 4. Then, the ultraviolet ray is diffused by the light diffusing layer 6 so as to be emitted from the right side.

The light modulating device 10 according to this embodiment is able to perform light modulation by controlling the position of the diaphragm 4 by applying the voltage.

Note that the electrode 2, which is transparent with respect to the ultraviolet ray, is disposed between the light introducing plate 1 and the diaphragm 4. If the thickness of the electrode 2 is similar to the thickness (2000 A) of a usual thin film, no problem arises when the foregoing operation is performed.

Figure 2:
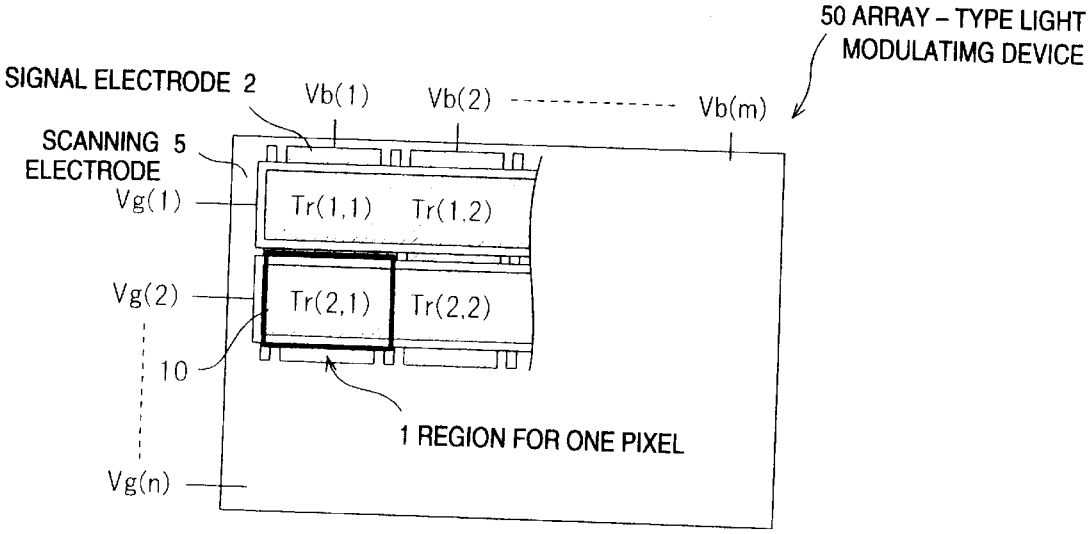
FIG. 2 is a plan view showing an array-type light modulating device in which the light modulating devices shown in FIG. 1 are disposed two-dimensionally.

In this embodiment, the light modulating devices 10 are disposed in a two-dimensional configuration consisting of n rows and m columns, as shown in FIG. 2. That is, the light modulating device 10 is disposed at each of intersections Tr(1, 1), Tr(1, 2), Tr(2, 1) and Tr(2, 2). Thus, an array-type light modulating device 50 is constituted.

Each light modulating device 10 corresponds to one pixel region. Note that the following description will be made about a 2 rows×2 columns-matrix which is portion of the matrix.

Note that the array-type light modulating device 50 is operated by a simple matrix operation.

Each of the electrodes of the light modulating devices 10 disposed on the same row is commonly connected so as to form scanning electrodes. Potential Vg is applied to each scanning electrode. Each of the electrodes of the light modulating devices 10 disposed on the same row is commonly connected so as to form signal electrodes. Potential Vb is applied to each signal electrode. Therefore, the voltage Vgs between the electrodes which is applied to each light modulating device 10 is (Vb−Vg).

To operate the array-type light modulating device 50, the electrodes 7 are scanned in a row-sequential manner in response to scanning signals. In synchronization with this, data signals corresponding to the scanned electrodes 7 are supplied to the electrodes 2.

The electrode 7 is supplied with three types of signals (voltages) including a resetting signal, a selection signal and a non-selection signal.

The resetting signal turns off (shields light for) the light modulating devices 10 in the corresponding row regardless of the previous state of each of the light modulating device 10. The voltage of the scanning electrode at this time is vg(r).

The selection signal is a signal (a signal for a writing operation) for writing data to the corresponding row. Simultaneously with the foregoing signal, the state of each light modulating device 10 is turned on (light transmission) or off light shielding) in accordance with the voltage applied to each the signal electrode. The voltage of each scanning electrode at this time is Vg(s).

The non-selection is a signal for use when no selection is performed. At this time, the state of the light modulating device 10 is not changed regardless of the voltage of the signal electrode. That is, the previous state is maintained. The voltage of the scanning electrode at this time is Vg(ns).

On the other hand, the electrode 2 is supplied with two types of signals (voltages) including ON and OFF signals.

The ON signal causes the light modulating devices 10 on the selected row to cause the state of each light modulating devices 10 to be turned on (light transmission state). The voltage of the electrode 2 at this time is Vb(on).

The OFF signal causes the light modulating devices 10 on the selected row to cause the state of each light modulating device 10 to be turned off (light shielded state). Since an assumption is made that the light modulating devices 10 are reset immediately before the turning-off operation, a signal for maintaining the previous state (the turned-off state) may be supplied when the state of each of the light modulating device 10 is turned off (the light shielded state). The voltage of the electrode 2 at this time is Vb(off).

The foregoing voltages of the scanning electrodes and those of the signal electrodes are combined, the voltage Vgs between the electrodes which is applied to the light modulating device 10 is classified into the six voltages below. Moreover, the voltage Vgs between the electrodes and the characteristics of the transmittance, specific conditions are given.

$$Vgs(r\text{-}on)=Vb(on)-Vg(r)=Vs(L)$$

$$Vgs(r\text{-}off)=Vb(off)-Vg(r)=Vs(L)$$

$$Vgs(s\text{-}on)=Vb(on)-Vg(s)=Vs(H)$$

$$Vgs(s\text{-}on)=Vb(off)-Vg(s)=Vth(L)$$

$$Vgs(ns\text{-}on)=Vb(on)-Vg(ns)=Vth(L)$$

$$Vgs(ns\text{-}off)=Vb(off)-Vg(ns)=Vth(H)$$

Figure 3:
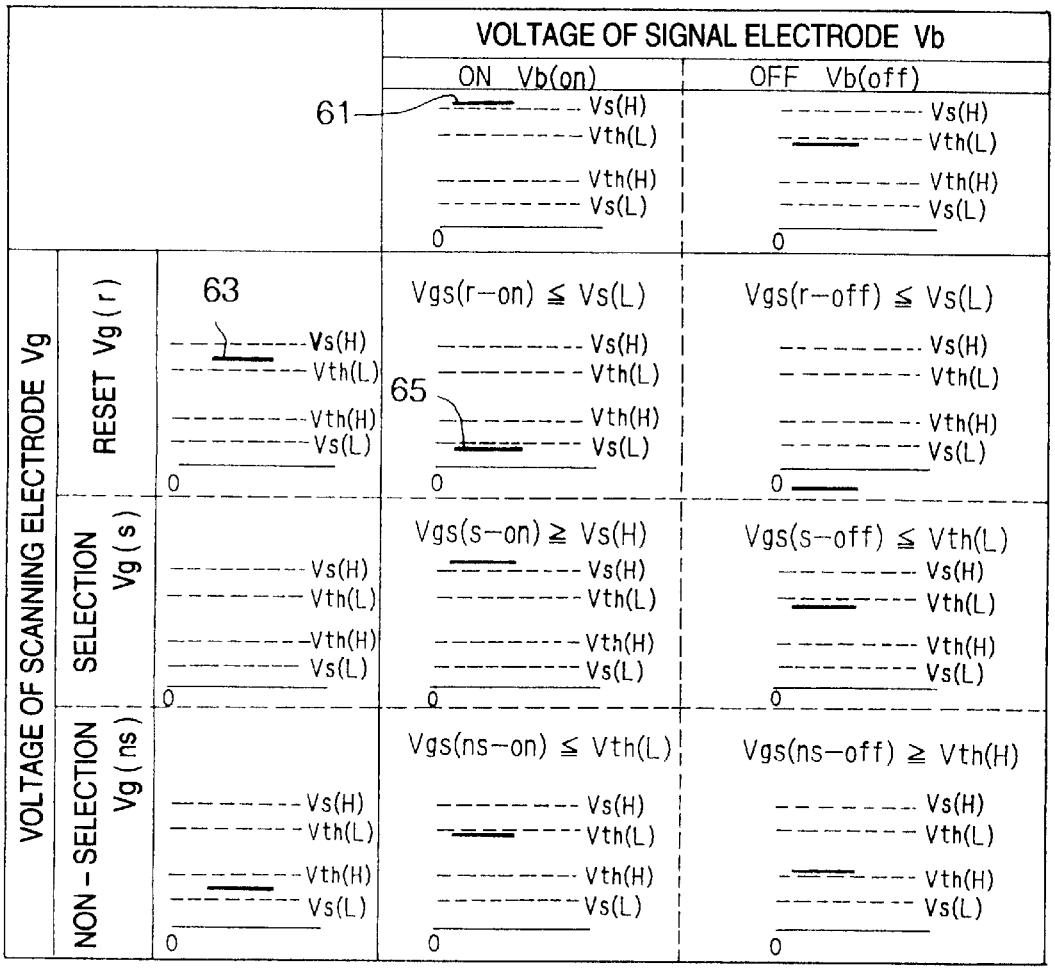
FIG. 3 is a diagram showing the relationship between the combination of scanning electrode voltages and signal electrode voltages and the voltage between electrode of the light modulating device.

The foregoing conditions are summarized as shown in FIG. 3.

When the voltage Vg of the scanning electrode is the resetting Vg(r) and the voltage Vb of the signal electrode is ON, that is, Vb(on), the scanning electrode voltage Vg (indicated with a solid line 63 shown in the drawing) between Vs(H) and Vth(L) is subtracted from the signal electrode voltage Vb (indicated with a solid line 61 shown in the drawing) higher than Vs(H). Thus, the value (indicated with a solid line 65 shown in the drawing) is smaller than Vs(L).

That is, the following relationship is satisfied:

$$Vgs(r\text{-}on)=Vs(L)$$

Similar processes are performed so that the six voltage levels are determined.

Then, a method of writing data on the matrix which incorporates the light modulating devices 10 disposed in the two-dimensional configuration by using the foregoing relationship between the voltage Vgs between the electrodes and the transmittance will now be described.

The matrix is the 2 row×2 column shown in FIG. 2 is used to write data. An assumption is made that the following ON and OFF data items are written on each light modulating device 10 of the matrix.

| | |
|---|---|
| Tr (1,1) → ON | Tr (1,2) → OFF |
| Tr (2,1) → OFF | Tr (2,2) → ON |

Figure 4:
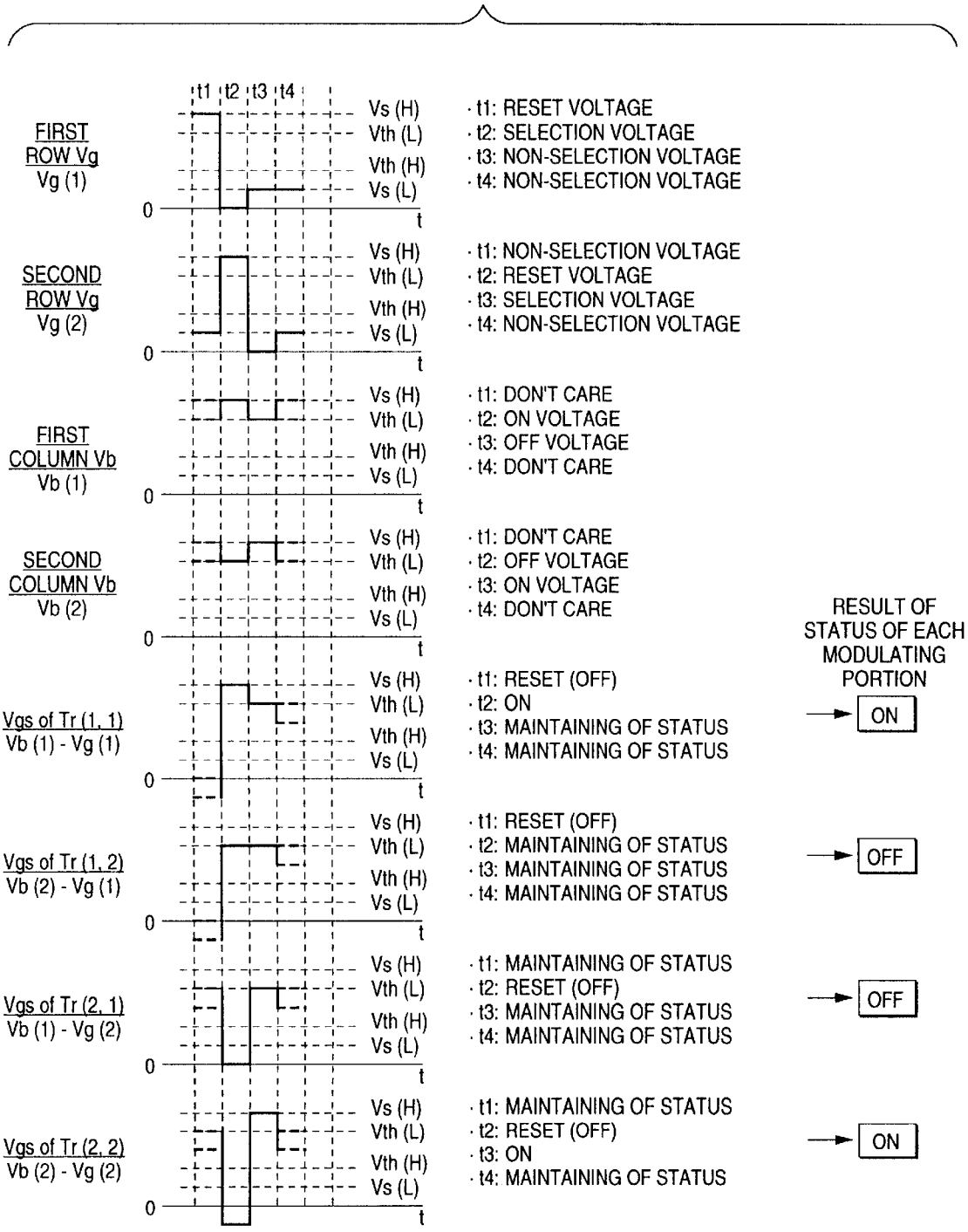
FIG. 4 is a diagram showing a method of writing data by applying voltages having different waveforms to each light modulating device according to the first embodiment.

The matrix is applied with the voltage in the waveform as shown in FIG. 4.

For example, a first row Vg(1) is applied with the following voltages:

t1: resetting voltage
t2: selection voltage
t3: non-selection voltage
t4: non-selection voltage A first column Vb(1) is applied with the following voltages:

t1: don't care
t2: ON voltage
t3: OFF voltage
t4: don't care

A first column Vb(1) is applied with the following voltages:

t1: don't care
t2: ON voltage
t3: OFF voltage
t4: don't care

After the light modulating device has been reset-scanned, writing scan for selecting a displacement operation or status maintaining operation of the device is performed. Thus, exertion of an influence of the state before the writing scan on a next operation owning to the hysteresis characteristic of the device can be prevented. Moreover, the hysteresis characteristic of the device enables the two-dimensional modulating array having the simple matrix structure can be operated without contradiction. That is, the pixels on the non-selected scanning lines reliably maintain the ON/OFF state set when the writing scan has been performed.

That is, in a case of the matrix Tr(1,1) on the first row and the first column, Vgs: Vb(1)—Vg(1). Therefore,

| |
|---|
| t1: resetting voltage (OFF) |
| t2: ON |
| t3: maintaining status |
| t4: maintaining status |

Therefore, the turned-on state at t2 is maintained (memorized), causing the matrix Tr(1,1) is brought to a state in which the light modulating device 10 is turned on. Similarly, the other matrices Tr(1,2) is turned off, Tr(2,1) is turned off and Tr(2,2) is turned on.

Figure 5:
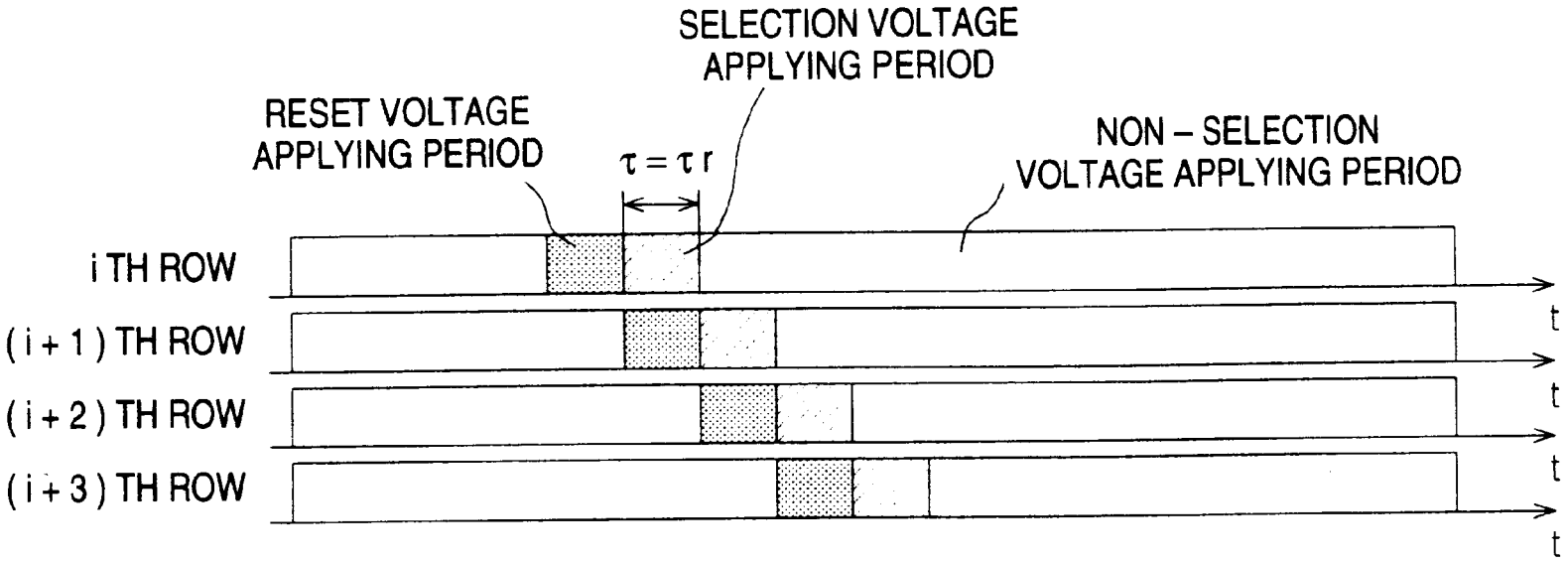
FIG. 5 is a chart for showing simultaneous execution of the resetting operation with the writing operation which is performed before the scanning operation according to the first embodiment.

As a result of the foregoing operation, the state of the scanning voltage on the light modulating device on each scanning line is as shown in a chart shown in FIG. 5. That is, the resetting voltage and the selection voltage are applied to the scanning electrode on an arbitrary i th row. Moreover, the selection voltage is applied to the i+1 th row scanning line without any delay, that is, immediately after the selection voltage applying period for the i th row scanning line. In this case, the resetting voltage applying period for the i+1 th row overlapped the selection voltage applying period for the i th row. Similarly, the resetting voltage applying periods for the other scanning lines overlap the selection voltage applying periods of the previous rows.

As described above, the light modulating device 10 on each scanning line is arranged such that the resetting operation is performed simultaneously with the selection period (the writing period) for each of the other rows. Therefore, a stable writing operation can be performed without a necessity of elongating the scanning time. Therefore, delay of the timing of the scanning time can be prevented owning to the elastic characteristic of each of the flexible portions of the light modulating devices and the supply of the resetting signal. As a result, the size of the array-type light modulating device can be enlarged and a precise structure of the same can be realized while a reliable operation is being realized.

Figure 6:
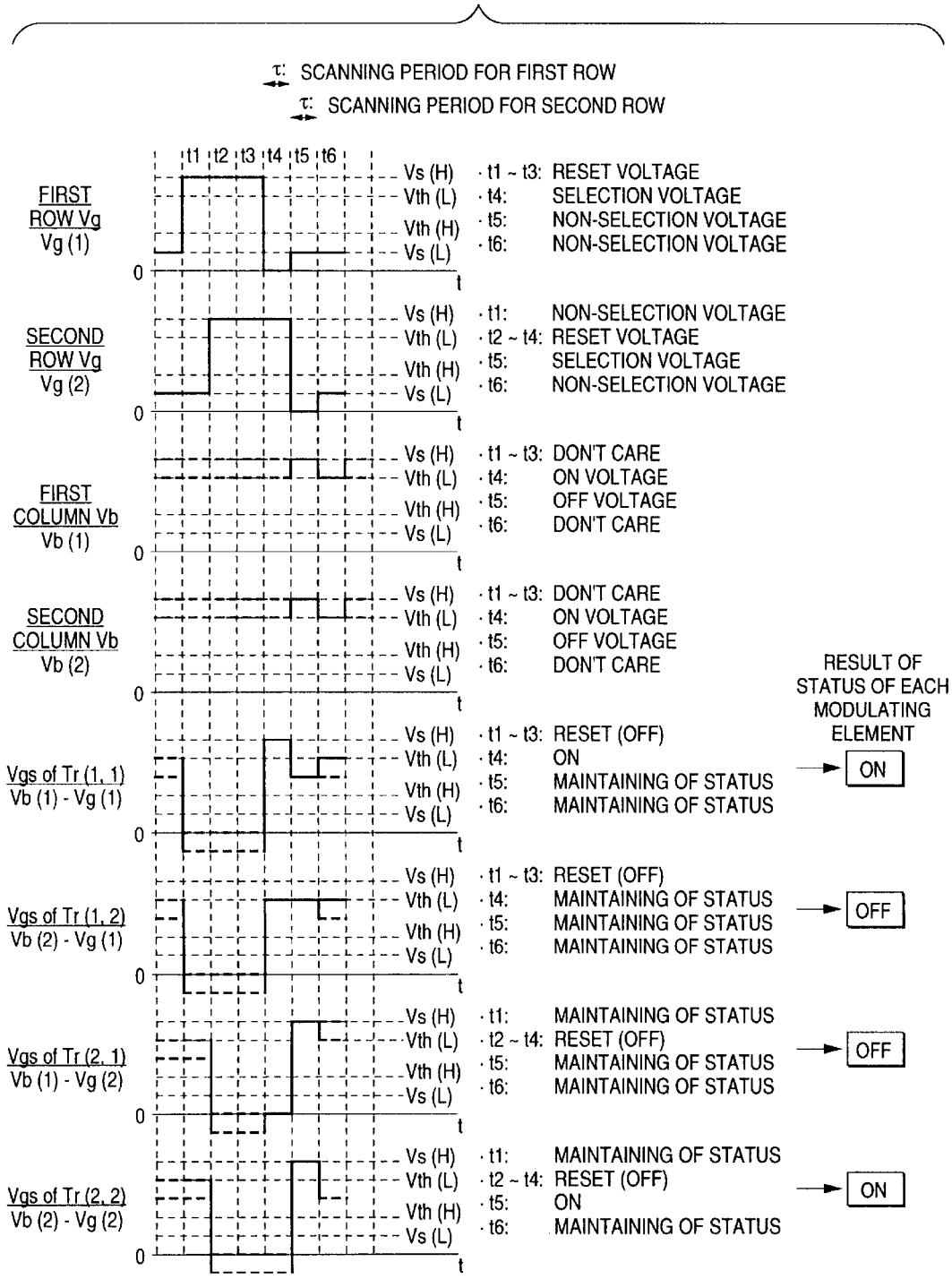
FIG. 6 is a diagram showing a method of writing data by applying voltages having different waveforms to each light modulating device according to a second embodiment.

A second embodiment of a method of operating the light modulating device according to the present invention will now be described. An operating method according to this embodiment is adapted to a structure incorporating light modulating devices each having a restoring time (the first transition time) $\tau f$ which is greatly delayed ($\tau f >> \tau r$). FIG. 6 shows waveform of voltages which are applied to the light modulating devices. In this embodiment, the period in which the resetting voltage is applied is made to be three times the period according to the first embodiment. That is, referring to FIG. 6, the resetting period t1 for the first row shown in FIG. 4 corresponds to t1 to t3 shown in FIG. 6. As described above, the period in which the resetting voltage is set to be three times the scanning period $\tau$.

Figure 7:
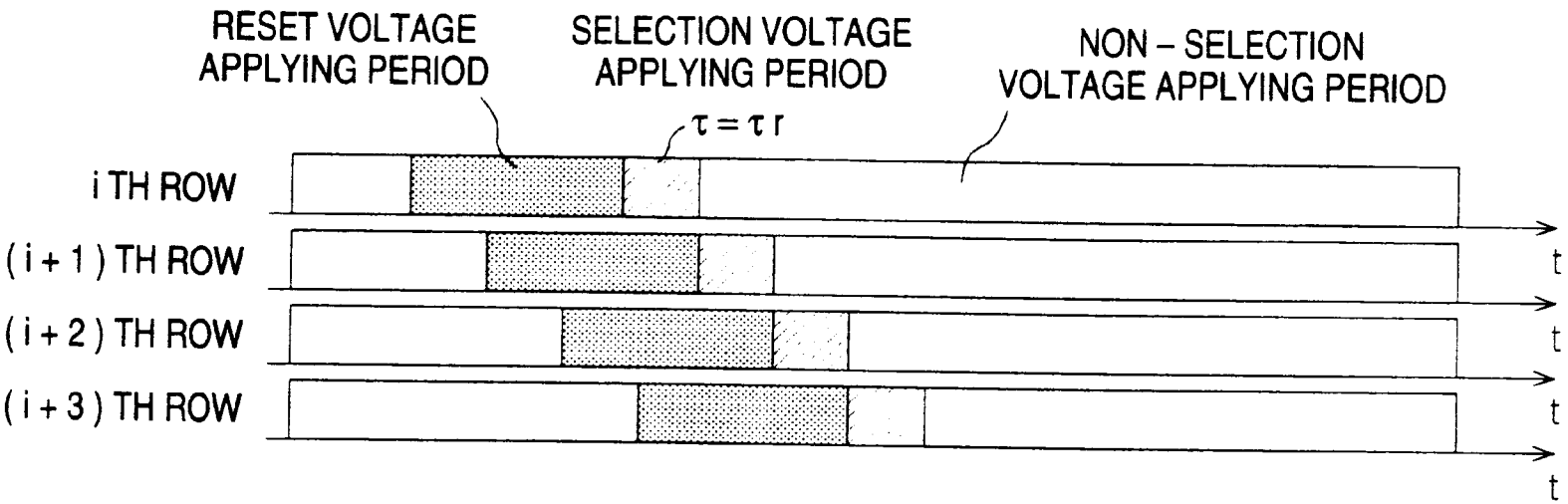
FIG. 7 is a chart showing simultaneous execution of the resetting operation with the writing operation which is performed before the scanning operation according to the first embodiment.

The states in which the scanning voltage are applied to the light modulating devices are as shown in a chart shown in FIG. 7. Referring to FIG. 7, similarly to the first embodiment, the selection voltage is applied to the i+1 th scanning line immediately after the selection voltage applying period for the i th row has been elapsed. In the foregoing case, the resetting voltage applying period for the i+1 th row is overlapped the selection voltage applying period for the i th row and the previous period (a portion of the resetting voltage applying period in the case shown in the drawing). Also the foregoing periods for the other scanning lines are overlapped similarly.

Since the resetting applying period is elongated as described above, an accurate response characteristic can be realized without a necessity of elongating the scanning period even if the light modulating devices require long restoring time.

Figure 8:
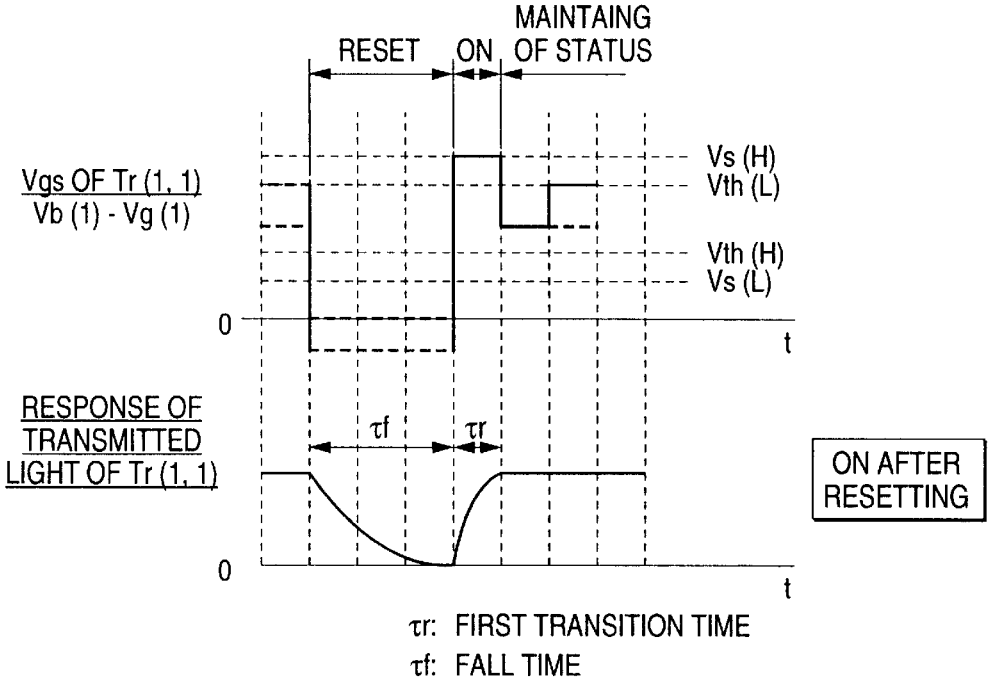
FIG. 8 is a graph showing a response characteristic of light transmitted through the light modulating device.
Figure 8:
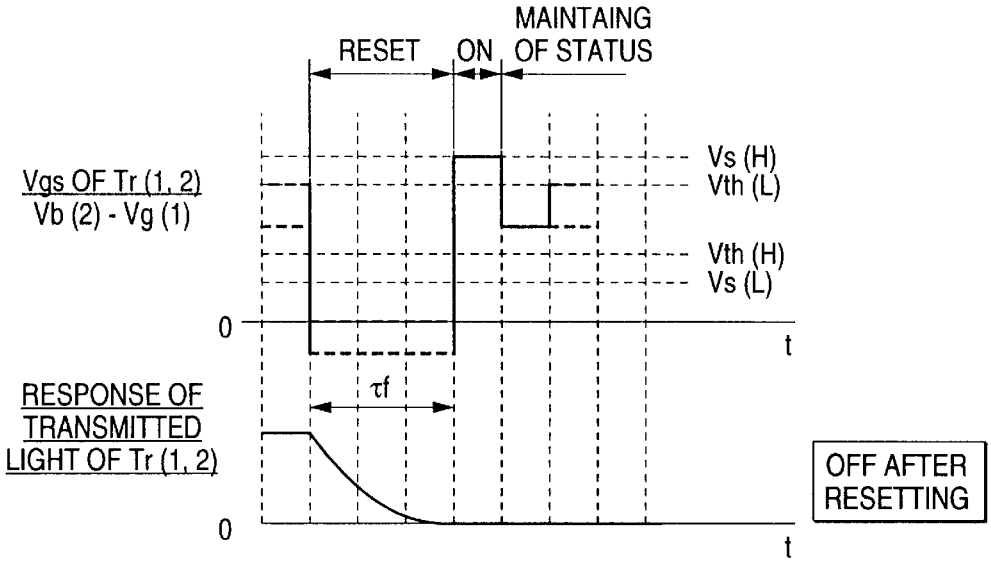

FIG. 8 is a chart showing voltage Vgs which is applied to the pixel. Tr(1,1) and pixel Tr(1,2) according to this embodiment and response of transmitted light. As shown in FIG. 8(*a*), the fall time $\tau f$ for the pixel Tr(1,1) is completed in the resetting period for the pixel. The signal for turning on the pixel is applied after the pixel has been reset. Therefore, the pixel can be turned on in the first transition time $\tau r$.

As shown in FIG. 8(*b*), the fall time $\tau f$ for the pixel Tr(1,2) is completed in the resetting period for the pixel. Then, the foregoing state is maintained so that the turned-off state of the pixel is maintained.

As described in each of the embodiments, it is preferable that the structure is employed in which the equilibrium state (the restored state) or the reset state of the light modulating device is a light-shielded state. If the reset state is a state in which the device is turned on (the light transmission state), output of "black" as the pixel causes light transmission to occur owning to the resetting operation. Thus, the contrast considerably deteriorates.

If the reset state is the turned-off state (the light shielded state), output of "black" inhibits light transmission. Therefore, the contrast is not substantially changed. When "white" is output, the output is reduced in only the resetting period. In this case, no visual problem arises. The reason for this lies in that reduction in the light quantity is very small quantity of about 1% owning to the resetting period for several rows in an example case of a panel having 500 to 1000 rows. Since the response of the device is slow, the output is not immediately changed from the turned-on state to the turned-off state. Therefore, light extinction takes place gradually. Moreover, the visual characteristic of a human being is insensitive with respect to change in the brightness when the brightness of the background is high.

As described above, in each of the foregoing embodiments, the light modulating devices use the light-introduction and diffusion effect shown in FIG. 1. The operating method according to the present invention is not limited to the foregoing method. The present invention may be applied to light modulating devices using the light-introduction and reflection. The structure is arranged such that a reflecting film made of aluminum or the like and inclined appropriately is formed on the diaphragm so that the reflecting film is formed into the thin flexible film. The foregoing light modulating device is arranged such that when the voltage is applied, light introduced into the thin flexible film is reflected by the reflection film toward the light introducing plate so as to be emitted. The present invention may also be applied to the following light modulating device.

Other examples of the structures of the light modulating devices for the flat display unit according to each embodiment will sequentially be described with reference to FIGS. 9 to 16.

An example will now be described which employs Fabry-Perot interference as the principle for the light modulation by electromechanically operating the thin flexible film. The Fabry-Perot interference causes an incident light beam repeats reflection and transmission in a state in which two planes are disposed opposite and in parallel with each other so that the light beam is divided into a multiplicity of light beams. Assuming that an angle of the plane made from a perpendicular incident light beam i, the optical path difference between adjacent light beams is given as $x=nt\cdot\cos i$. Note that n is the refractive index between the two planes and t is the distance. If the optical path difference x is an integer multiple of the wavelength $\lambda$, the transmitted light beams intensify mutually. If the optical path difference x is an odd-integer of the half wavelength, the transmitted light beams weaken mutually. If the phase is not changed at the time of the reflection, When $2nt\cdot\cos i=m\lambda$, transmitted light is maximum, and when $2nt\cdot\cos i=(2m+1)\lambda/2$, transmitted light is minimum, where m is a positive integer.

Thus, the optical path difference x is made to be a predetermined value by moving the thin flexible film. Thus, light emitted from the transparent substrate can be light-modulated so as to be emitted from the thin flexible film.

A specific structure in which the light modulating devices using the Fabry-Perot interference are combined with flat light sources to constitute a flat display unit will now be described.

Figure 9:
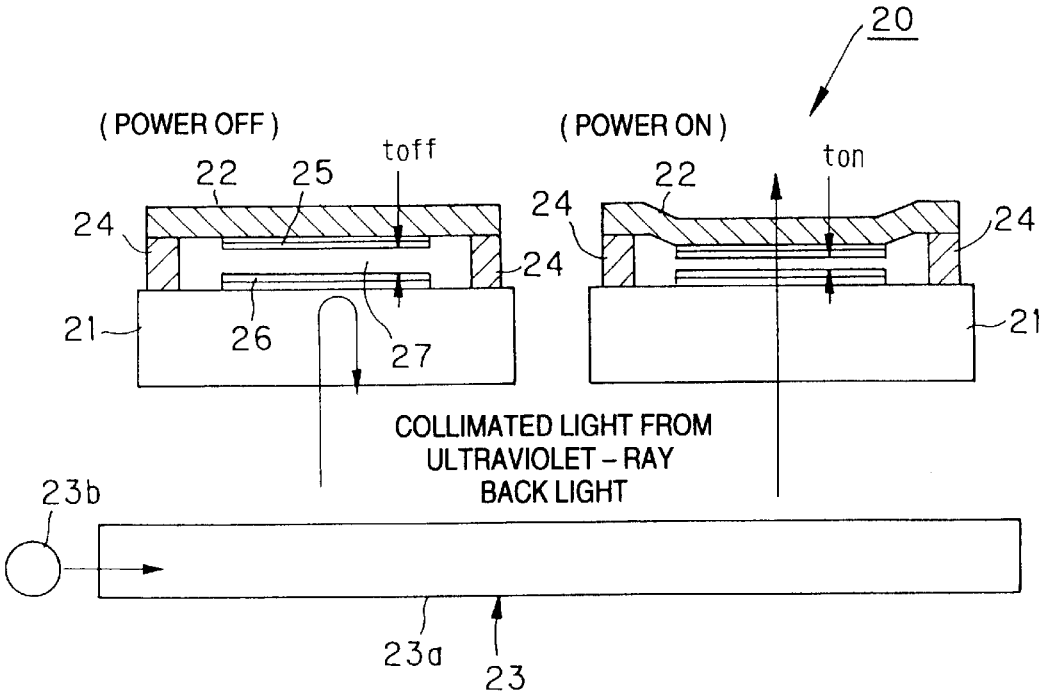
FIG. 9 is a diagram showing the operation of a light modulating device using the multilayered interference effect.

FIG. 9 is a schematic cross sectional view showing the light modulating device and the flat light source. The light modulating device 20 incorporates a substrate 21 which is transparent with respect to an ultraviolet ray and on which electrodes on the substrate are formed and electrodes on a diaphragm (not shown) disposed on the diaphragm 22 are applied with the voltage. Thus, the diaphragm 22 is displaced so that a multilayered-film interference effect is generated so that the ultraviolet ray emitted from the flat light source 23 is light-modulated.

The flat light source 23 incorporates a plate-like flat light source unit 23*a* and an ultraviolet-ray lamp (low-pressure mercury lamp) 23*b* for black light disposed on the side of the flat light source unit 23*a*. The flat light source 23 makes the ultraviolet ray emitted from the low-pressure mercury lamp 23*b* for black light made incident on the side surface of the flat light source unit 23*a* so as to be emitted from the upper surface of the flat light source unit 23*a*.

Figure 10:
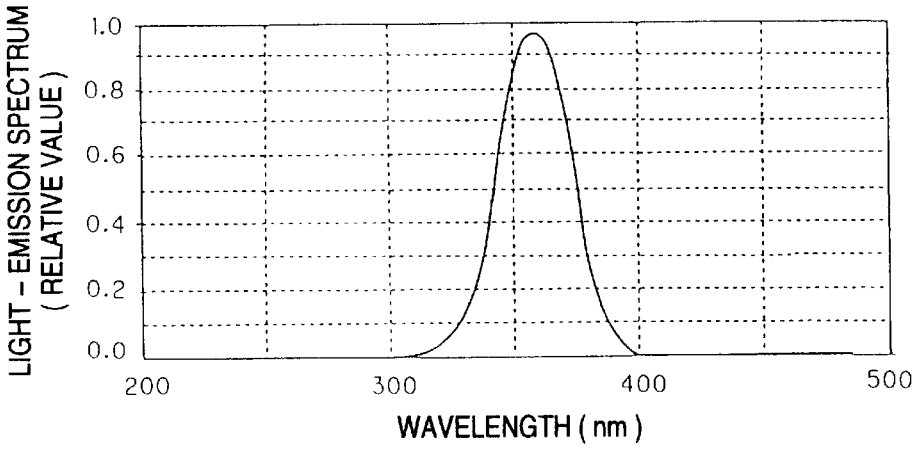
FIG. 10 is a graph showing the spectral characteristics of a back light comprising a low-pressure mercury lamp.

When fluorescent substances (for example, $BaSi_2O_5$: $Pb^{2+}$) for black light is applied to the inner wall of the low-pressure mercury lamp 23*b*, the spectral characteristics of the emitted ultraviolet ray, as shown in FIG. 10, has central wavelength $\lambda_0$ in the vicinity of 360 nm. The foregoing ultraviolet ray is used as light for the back light.

A pair of electrodes (not shown) on the substrate are disposed on the substrate 21 such that the electrodes are disposed apart from each other for a predetermined distance in a direction perpendicular to the drawing sheet showing FIG. 9. Dielectric-multilayered-film mirrors 25 and 26 are disposed between the on-substrate electrodes on the substrate 21.

The two ends of the diaphragm 22 are supported by support portions 24 formed on the substrate 21 so as to be disposed apart from the substrate 21 for a predetermined distance. A dielectric-multilayered-film mirror 25 is disposed on the lower surface of the diaphragm 22 such that the dielectric-multilayered-film mirror 25 is disposed apart from the dielectric-multilayered-film mirror 26 on the substrate 21 for predetermined distance t.

An assumption is made that the length of a cavity 27 of the light modulating device 20 structured as described above which is realized when application of the voltage to each electrode is interrupted is toff (a state shown in the left-hand portion of FIG. 9). The foregoing length can be controlled when the device is manufactured. The length of the cavity 27 is shortened by dint of the static electric power after the voltage has been applied. An assumption is made that the shortened length is ton (in a right-hand state of FIG. 9). Setting of ton can appropriately be permitted by using the balance between the electrostatic force which acts on the diaphragm 22 owning to the application of the voltage to each electrode and the restoring force which is generated owning to the deformation of the diaphragm 22.

To perform furthermore stable control, spacers (not shown) may be formed on the electrodes to cause the spacers to physically control the displacement of the diaphragms 22. Thus, the quantity of displacement of each diaphragm 22 is made to be constant. When the spacers are made of insulating material, its dielectric constant (1 or higher) attains an effect of lowering the voltage which is applied to each electrode. When the spacers have conductivity, the foregoing effect is furthermore enhanced. The spacers and the electrodes may be made of the same material.

Note that ton and toff are set as follows (m=1).

$$ton=\tfrac{1}{2}\times\lambda_0=180\text{ nm}$$

($\lambda_0$: central wavelength of ultraviolet ray)

$$toff=\tfrac{3}{4}\times\lambda_0=270\text{ nm}$$

Figure 11:
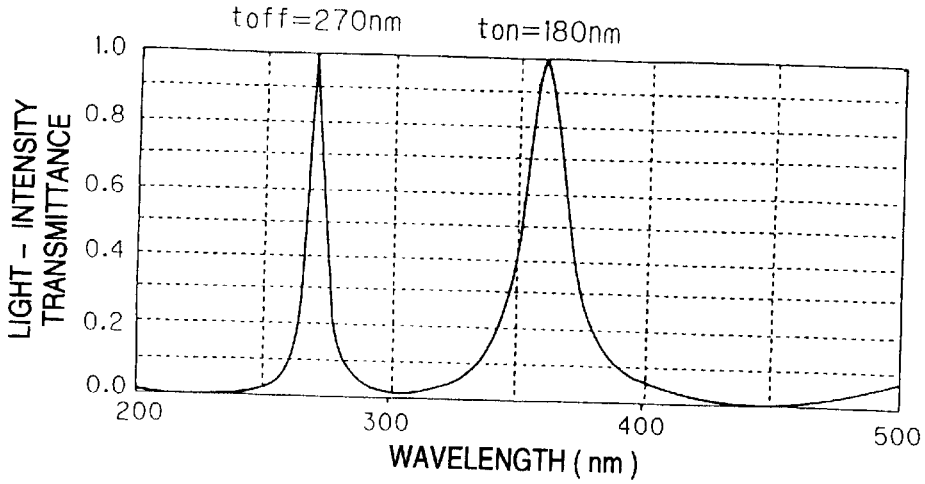
FIG. 11 is a graph showing light-intensity light transmittance of the light modulating device realized when the back light having the characteristic shown in FIG. 10.

The dielectric multilayered-film mirrors 25 and 26 have light-intensity reflectance R which is 0.85. The cavity 27 is filled with air or rare gas having refractive index n which is one. Since ultraviolet rays are collimated, incident angle i (an angle made between the perpendicular line of the dielectric-multilayered-film mirror and the incident light beam) on the light modulating portion 20 is substantially zero. At this time, the light-intensity transmittance of the light modulating device 20 is as shown in FIG. 11.

Therefore, when no voltage is applied, toff is 270 nm. Therefore, the light modulating device 20 does not substantially permit transmission of the ultraviolet ray.

If the voltage is applied and, therefore, ton is made to be 180 nm, the light modulating device 20 permits transmission of the ultraviolet ray.

If the conditions for the interference are satisfied, combination of the length t of the cavity 27, the refractive index n and light-intensity reflectance R of the dielectric multilayered-film mirrors 25 and 26 may arbitrarily be determined.

When the length t is continuously changed, the central wavelength of the transmission spectrum can arbitrarily be changed. Thus, the quantity of transmitted light can continuously be controlled. That is, the gradation can be controlled by changing the voltage between the electrodes.

As a modification of the light modulating device 20, a back light incorporating a low-pressure mercury lamp employed in place of the low-pressure mercury lamp 23*b* may be employed.

Figure 12:
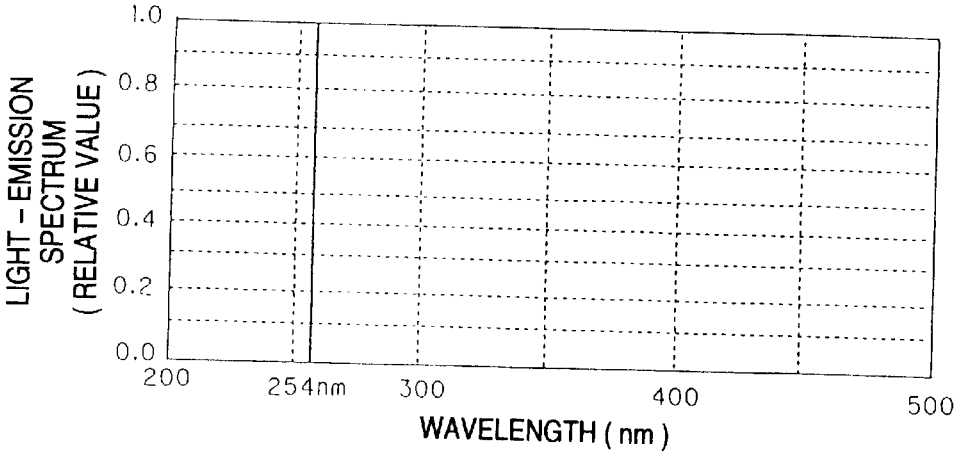
FIG. 12 is a graph showing the spectral characteristics of the ultraviolet-ray back light.

That is, the low-pressure mercury lamp for emitting light mainly composed of line spectrum of 254 nm is employed as the light source and combination with a transparent substrate made of quarts glass is employed so that the back light unit is constituted. The other wavelengths are cut by filters. The spectral characteristics of the ultraviolet-ray back light are as shown in FIG. 12.

The material (the diaphragm, the dielectric-multilayered-film mirrors and the substrate) for constituting the effective pixel area of the foregoing light modulating device must be material which permits transmission of an ultraviolet ray having a wavelength of 254 nm.

Note that ton and toff are set as follows (m=1).

$$ton=\tfrac{1}{2}\times\lambda_0=127\text{ nm}$$

($\lambda_0$: central wavelength of ultraviolet ray)

$$toff = \frac{3}{4} \times \lambda_0 = 191 \text{ nm}$$

Figure 13:
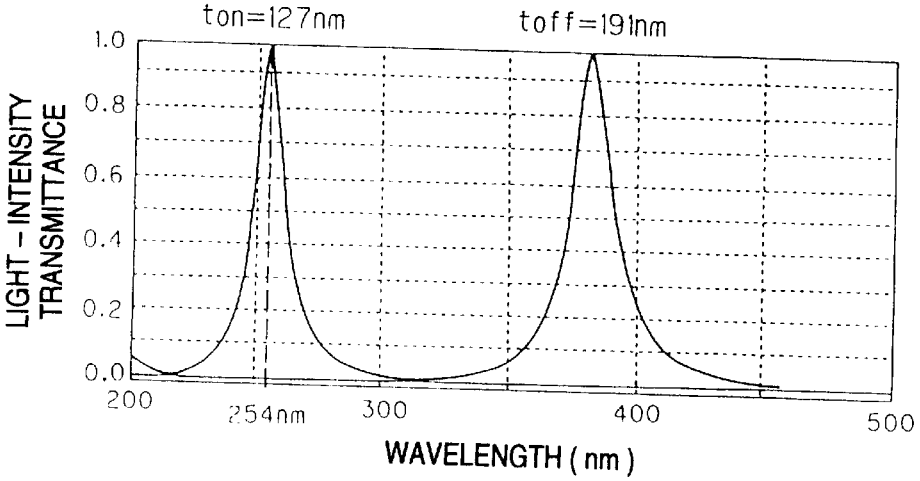
FIG. 13 is a graph showing light-intensity light transmittance of the light modulating device.

The other conditions are the same as those of the foregoing example, in which R=0.85, n=1 and i=0. The light-intensity transmittance of the light modulating device at this time is as shown in FIG. 13.

When no voltage is applied, toff=191 nm. Thus, the light modulating device does not substantially permit transmission of the ultraviolet ray. When ton=127 because of application of the voltage, the light modulating device permits transmission of the ultraviolet ray.

In the foregoing modification, the ultraviolet ray is a line spectrum ray, a considerably high energy transmittance is attained. Thus, high-efficiency and contrast modulation can be performed.

Also in the foregoing modification, if the conditions for the interference are satisfied, combination of the length t of the cavity 27, the refractive index n and light-intensity reflectance R of the dielectric multilayered-film mirrors 25 and 26 may arbitrarily be determined.

When the length t is continuously changed by varying the voltage level, the central wavelength of the transmitted spectrum can arbitrarily be changed. Thus, the quantity of transmitted light can continuously be controlled. That is, the gradation can be controlled by varying the applied voltage.

Another modification of the light modulating device will now be described with reference to FIG. 14.

Figure 14:
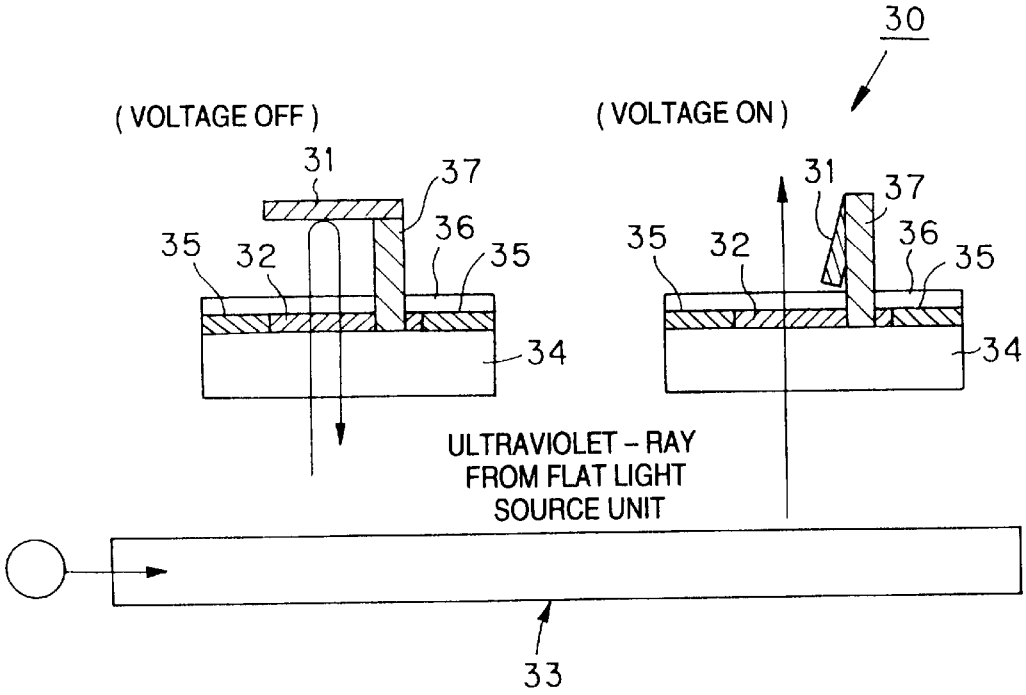
FIG. 14 is a schematic cross sectional view showing another modification of the light modulating device and the flat light source.

FIG. 14 is a schematic cross sectional view showing the light modulating device and a flat light source. A light modulating device 30 is structured such that a light shielding plate 31 is displaced by electrostatic stress generated owning to application of voltages to the light shielding plate 31 and the transparent electrode 32. Thus, the passage for the ultraviolet ray emitted from the flat light source 33 is changed so that light modulation is performed. The structure of the flat light source 33 is similar to that of the flat light source 23 shown in FIG. 9.

The transparent electrode 32 is formed on a substrate 34 which permits transmission of the ultraviolet ray so that the ultraviolet ray is transmitted. An insulating light shielding film 35 is provided for the portions of the substrate 34 except for the transparent electrode 32. Insulating films 36 a reformed on the upper surfaces of the transparent electrode 32 and the light shielding film 35.

The light shielding plate 31 is formed into a cantilever structure supported above the substrate 34 such that a predetermined distance is provided from the substrate 34 by support columns 37 stood erect on the substrate 34. The shape of the light shielding plate 31 corresponds to the shape of the opposite transparent electrode 32 formed on the substrate 34. The size of the light shielding plate 31 is somewhat larger than that of the transparent electrode 32.

The light shielding plate 31 is constituted by a thin flexible film having conductivity in the form of a single or a plurality of thin conductive firms made of material which absorbs or reflects the ultraviolet ray.

Specifically, the material exemplified by a thin metal film made of aluminum or chrome which reflects the ultraviolet ray or a semiconductor, such as polysilicon which absorbs the ultraviolet ray is employed to form a single structure. As an alternative to this, a structure may be employed in which metal is evaporated to an insulating film made of silicon oxide or silicon nitride or a thin semiconductor film made of polysilicon. As an alternative to this, a composite structure may be employed in which a filter in the form of a dielectric multilayered film or the like is evaporated.

The light modulating device 30 structured as described above is operated as follows: in a state in which no voltage is applied between the light shielding plate 31 and the transparent electrode 32 of the light modulating device 30, the light shielding plate 31 is positioned opposite to the transparent electrode 32. Thus, the ultraviolet ray allowed to transmit the transparent electrode 32 is absorbed or reflected by the light shielding plate 31 (in a left-hand state shown in FIG. 14).

When the voltage is applied between the light shielding plate 31 and the transparent electrode 32, the electrostatic force acting on the two elements causes the light shielding plate 31 to be displaced toward the transparent electrode 32 while the light shielding plate 31 are being twisted (in a right-hand state shown in FIG. 14). The ultraviolet ray emitted from the flat light source 33 and allowed to transmit the transparent electrode 32 is not shielded by the light shielding plate 31. That is, the ultraviolet ray is emitted upwards.

When the voltage applied to the space between the light shielding plate 31 and the transparent electrode 32 is made to again be zero, the light shielding plate 31 is restored to an initial position by the elasticity of each of the light shielding plate 31 and the support columns 37.

Another modification of the light modulating device will now be described with reference to FIGS. 15 and 16.

Figure 15A:
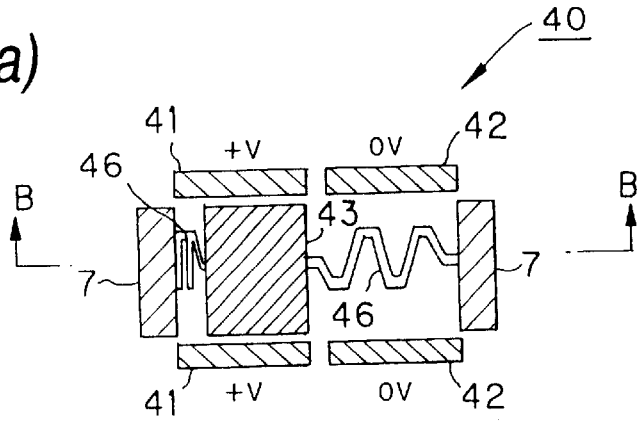
FIG. 15 is a diagram showing the structure of the modification of the light modulating device and a light shielding operation.
Figure 15B:
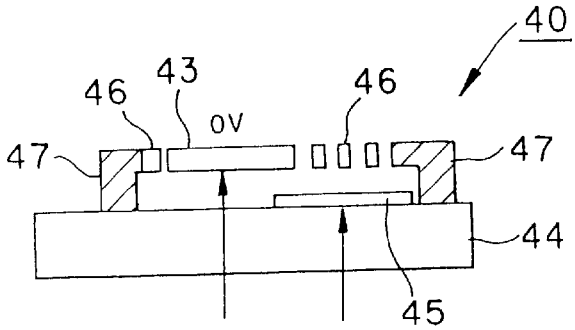

FIG. 15 is a schematic structural view showing a light modulating device 40. FIG. 15(*a*) is a plan view, and FIG. 15(*b*) is a cross sectional view taken along line B—B shown in FIG. 15(*a*).

The light modulating device 40 is structured such that the electrostatic force generated owning to application of the voltages to the opposite electrodes 41 and 42 and the electrode light-shielding plate 43 is used to displace the electrode light-shielding plate 43 to the right or left in a state shown in FIG. 15. Thus, the light modulating device 40 shields or permits transmission of light emitted from a flat light source (not shown).

The opposite electrodes 41 and 42 are, on the substrate 44 which permits transmission of the ultraviolet ray, are disposed opposite to each other such that a predetermined distance is provided. Thus, two pairs are in parallel provided as shown in FIG. 15(*a*). A light shielding film 45 is disposed between the right-hand opposite electrodes 42 formed on the substrate 44 shown in FIG. 15.

The electrode light-shielding plate 43, which is capable of displacing to the right and left, is disposed between the opposite electrodes 41 and 42 such that a predetermined upward distance is provided from the substrate 44, as shown in FIG. 15(*b*). That is, the right and left sides of the electrode light-shielding plate 43 are supported by the support portions 47 through a flexible member, such as a broken-line spring 46. The electrode light-shielding plate 43 is displaced to the right and left in a state shown in FIG. 15 by the electrostatic force generated owning to the application of the voltages to the opposite electrodes 41 and 42 while the broken-line spring 46 is being elastically deformed. The lateral length of the electrode light-shielding plate 43 is substantially half the distance between the support portions 47 in the lateral direction.

The light modulating device 40 structured as described above is operated as follows: when the voltage is applied to the left-hand opposite electrode 41 shown in FIG. 15 in a state in which no voltage is applied to the electrode light-shielding plate 43 of the light modulating device 40, the electrode light-shielding plate 43 is moved toward the position between the left-hand opposite electrodes 41 shown in FIG. 15 by dint of the electrostatic force (in a state shown in FIG. 15). As a result, light emitted from the flat light source and allowed to transmit the substrate 44 because light is not shielded by the light shielding film 45 is shielded by the electrode light-shielding plate 43.

Figure 16A:
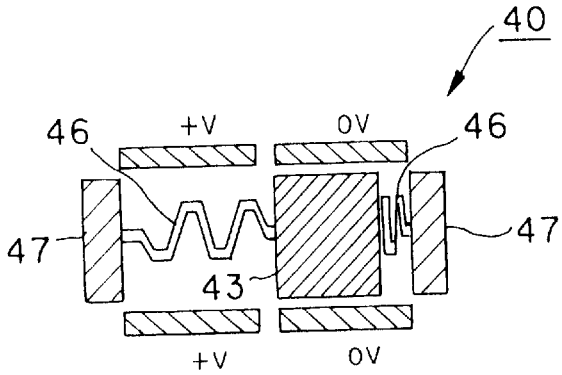
FIG. 16 is a diagram showing a light-introducing state of the light modulating device shown in FIG. 15.
Figure 16B:
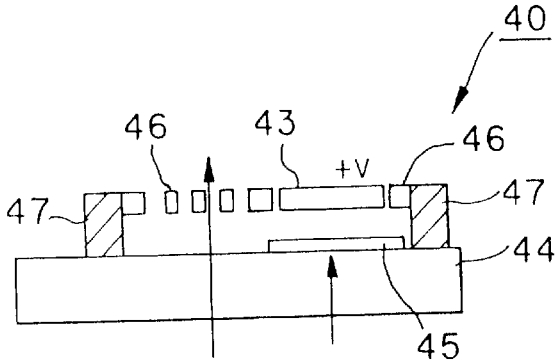
Figure 17:
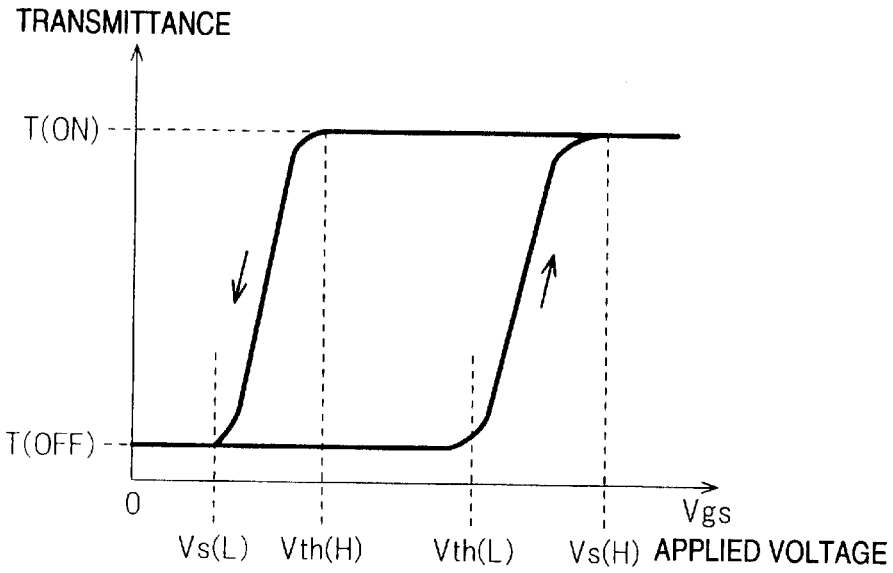
FIG. 17 is a graph showing the hysteresis characteristic of light transmittance of the electromechanical light modulating device with respect to the applied voltage.
Figure 18:
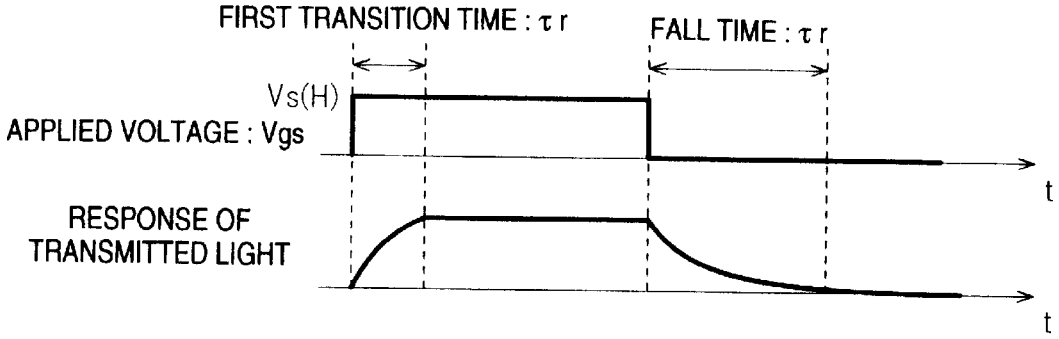
FIG. 18 is a graph showing the response characteristic of transmitted light of the light modulating device with respect to the applied voltage.

When the voltage is applied to only the left-hand opposite electrode 41 shown in FIG. 16 in a state in which the +voltage is applied to the electrode light-shielding plate 43, the electrode light-shielding plate 43 is moved toward the position between the right-hand opposite electrodes 42 shown in FIG. 16 by dint of the electrostatic force (in a state shown in FIG. 16). As a result, light emitted from the flat light source and allowed to transmit the substrate 44 because light is not shielded by the light shielding film 45 is not shielded by the electrode light-shielding plate 43. Light is emitted upwards in a state shown in FIG. 16(*b*).

When the applied voltage is made to again be zero, the electrode light-shielding plate 43 is returned to the initial position by the elastic force of the broken-line spring 46 and the electrostatic force.

A variety of the structures of the light modulating devices can be employed. The present invention is not limited to the foregoing structures and any structure having a similar function may be employed.

As described above, according to the present invention, there is provided the method of operating the array-type light modulating device incorporating the electromechanical light modulating devices which are arranged to perform light modulation by using an operation for displacing the flexible portions by dint of electrostatic force and an elastic restoring operation of the flexible portions and which are disposed into a two-dimensional matrix configuration, the method of operating the array-type light modulating device comprising the steps of: performing the resetting operation which restores the light modulating devices, which is performed for the scanning lines except for the scanning lines which are reset and which is performed simultaneously with the writing scan for selecting either of an operation for displacing the devices or an operation for maintaining the present state so that the writing scan of each scanning line is continuously performed. As a result, even if the light modulating devices require a long elastic restoring time, the light modulating devices are able to furthermore quickly display images without a time loss. Thus, the response time can significantly be shortened.

Since the reset scanning time is set to be an integer multiple of writing scan time, even if the light modulating devices which require a long elastic restoring time are able to perform appropriate scanning and permitted to have a high response characteristic without a time loss.

When a flat display unit is operated such that a flat light source for emitting ultraviolet rays is disposed opposite to the array-type light modulating device having the electrode light modulating devices disposed in the matrix configuration and the fluorescent members are provided for the opposite surface of the flat light source interposing the array-type light modulating devices so as to use light emitted from the light modulating devices to cause the fluorescent members to emit light. Thus, a flat display unit which is free from lowering of the contrast and which has a high speed response characteristic can be obtained.

What is claimed is:

1. A method of operating an array-type light modulating device incorporating electromechanical light modulating devices which are arranged to perform light modulation by using an operation for displacing flexible portions by dint of electrostatic force and an elastic restoring operation of said flexible portions and which are disposed into a two-dimensional matrix configuration, said method of operating an array-type light modulating device comprising the steps of:

performing a resetting scan operation which restores said light modulating devices for scanning lines; and performing a writing scan operation for selecting either of an operation for displacing said devices or an operation for maintaining the present state for scanning lines, wherein the resetting scan operation for selected scanning lines is performed within writing scan operation period for scanning lines except for the selected scanning lines.

2. A method of operating an array-type light modulating device according to claim 1, wherein the resetting scan operation for selected scanning lines is performed simultaneously with writing scan operation for scanning lines except for the selected scanning lines so that the writing scan operation of each scanning line is continuously performed.

3. The method of claim 2, wherein within each scanning line of the two-dimensional matrix, the resetting scan operation precedes the writing scan operation in time.

4. A method of operating an array-type light modulating device according to claim 1, wherein reset scanning operation time is set to be longer than time required for each flexible portion to elastically restore the original position.

5. A method of operating an array-type light modulating device according to any one of claims 1, wherein the elastic restoring operation of each light modulating device is an operation which realizes a light shielded state after the restoration has been completed.

6. The method of claim 5, wherein within each scanning line of the two-dimensional matrix, the resetting scan operation precedes the writing scan operation in time.

7. A method of operating an array-type light modulation device according to claim 1, said array-type light modulation device forming a flat display unit, said flat display unit incorporating said array-type light modulating device, a flat light source disposed opposite to said array-type light modulating device and fluorescent members disposed opposite to said flat light source such that said array-type light modulating device is interposed, said method of operating a flat display unit further comprising:

using light emitted from said array-type light modulating device to cause fluorescent members to emit light to perform display.

8. A method of operating a flat display according to claim 7, wherein said flat light source is a light source for emitting ultraviolet rays for exciting said fluorescent members.

9. The method of claim 1, wherein within each scanning line of the two-dimensional matrix, the resetting scan operation precedes the writing scan operation in time.

10. A method of operating an array-type light modulating device incorporating electromechanical light modulating devices which are arranged to perform light modulation by using an operation for displacing flexible portions by dint of electrostatic force and an elastic restoring operation of said flexible portions and which are disposed into a two-dimensional matrix configuration, said method of operating an array-type light modulating device comprising the steps of:

performing a resetting scan operation which restores said light modulating devices for scanning lines; and performing a writing scan operation for selecting either of an operation for displacing said devices or an operation for maintaining the present state for scanning lines, wherein the resetting scan operation for selected scanning lines is performed within writing scan operation period for scanning lines except for the selected scanning lines, wherein reset scanning operation time is set to be an integer multiple of writing scan time.

11. The method of claim 10, wherein the resetting scan operation for selected scanning lines is performed simultaneously with writing scan operation for scanning lines except for the selected scanning lines so that the writing scan operation of each scanning line is continuously formed.

12. The method according to claim 10, wherein reset scanning operation time is set to be longer than time required for each flexible portion to restore the original position.

13. The method of claim 10, wherein the elastic restoring operation of each light modulating device is an operation which realizes a light shielded state after the restoration has been completed.

* * * * *